US008241071B1

(12) United States Patent
Hayama

(10) Patent No.: US 8,241,071 B1
(45) Date of Patent: Aug. 14, 2012

(54) ELECTRIC CABLE CONNECTING DEVICE

(76) Inventor: Frank Hayama, Meguro-Ku (JP)

( * ) Notice: Subject to any disclaimer, the term of this patent is extended or adjusted under 35 U.S.C. 154(b) by 0 days.

(21) Appl. No.: 13/135,504

(22) Filed: Jul. 7, 2011

(51) Int. Cl.
*H01R 9/22* (2006.01)

(52) U.S. Cl. ..... 439/709

(58) Field of Classification Search ..... 439/709–722
See application file for complete search history.

(56) References Cited

U.S. PATENT DOCUMENTS

| | | | | |
|---|---|---|---|---|
| 4,636,025 | A | 1/1987 | Norris | |
| 4,991,988 | A * | 2/1991 | Snell et al. | 401/111 |
| 5,069,636 | A * | 12/1991 | Shimirak et al. | 439/412 |
| 5,171,169 | A | 12/1992 | Butcher et al. | |
| 5,221,219 | A | 6/1993 | Thomson | |
| 5,254,020 | A | 10/1993 | Obligar | |
| 5,440,073 | A | 8/1995 | Lin et al. | |
| 5,573,423 | A | 11/1996 | Lin et al. | |
| 5,688,131 | A | 11/1997 | Byfield, Jr. | |
| 5,725,399 | A | 3/1998 | Albiez et al. | |
| 5,733,152 | A | 3/1998 | Freitag | |
| 6,364,720 | B1 | 4/2002 | Liang | |
| 6,459,233 | B1 | 10/2002 | Liang | |
| 6,478,587 | B2 * | 11/2002 | Sharples | 439/131 |
| 7,850,123 | B2 * | 12/2010 | Stuehrenberg et al. | 244/137.4 |
| 2008/0078882 | A1 * | 4/2008 | Stuehrenberg et al. | 244/137.4 |

* cited by examiner

*Primary Examiner* — James Harvey
(74) *Attorney, Agent, or Firm* — Charles E. Baxley

(57) ABSTRACT

An electric cable connecting device includes a base member having a terminal post for engaging with an electric cable, a housing having a chamber for receiving a torque limiting mechanism which includes a follower engaged in the housing and having an inner thread for engaging with the terminal post and having a number of ratchet teeth, and a release member engaged in the housing and having a number of ratchet teeth biased to engage with the ratchet teeth of the follower, the release member is limited to slide relative to the housing only, and the release member is released when a torque applied to the housing and onto the terminal post is greater than a predetermined torque value of the spring biasing member.

6 Claims, 6 Drawing Sheets

ELECTRIC CABLE CONNECTING DEVICE

BACKGROUND OF THE INVENTION

1. Field of the Invention

The present invention relates to an electric cable connecting device or assembly, and more particularly to an electric cable connecting device or assembly including a protective device or torque limiting device for preventing the connecting device from being over rotated or over turned and for preventing the connecting device from being damaged brutally by the user.

2. Description of the Prior Art

Typical electric cable connecting devices comprise a conductive clamp or circular ring for attaching or mounting or engaging with the terminal post of various kinds of electric facilities, and one or more fasteners for mounting or securing the clamp or circular ring to the terminal post of the electric facilities.

For example, U.S. Pat. No. 4,636,025 to Norris, U.S. Pat. No. 5,171,169 to Butcher et al., U.S. Pat. No. 5,221,219 to Thomson, U.S. Pat. No. 5,254,020 to Obligar, U.S. Pat. No. 5,440,073 to Lin et al., U.S. Pat. No. 5,573,423 to Lin et al., U.S. Pat. No. 5,688,131 to Byfield, Jr., U.S. Pat. No. 5,725,399 to Albiez et al., U.S. Pat. No. 5,733,152 to Freitag, U.S. Pat. No. 6,364,720 to Liang, and U.S. Pat. No. 6,459,233 to Liang disclose several of the typical electric cable connecting devices each comprising one or more fasteners for mounting or securing an electric conductive clamp ring or circular ring to a terminal post of an electric facility, or for mounting or securing an electric cable to a terminal post of an electric facility.

However, the fasteners may be over rotated or over turned relative to the terminal post of the electric facilities, and the terminal post or the clamp ring or circular ring may be damaged by the user when the fasteners are brutally rotated relative to the terminal post of the electric facilities.

The present invention has arisen to mitigate and/or obviate the afore-described disadvantages of the conventional electric cable connecting devices.

SUMMARY OF THE INVENTION

The primary objective of the present invention is to provide an electric cable connecting device or assembly including a protective device or torque limiting device for preventing the connecting device from being over rotated or over turned and for preventing the connecting device from being damaged brutally by the user.

In accordance with one aspect of the invention, there is provided an electric cable connecting device comprising a base member including a terminal post having an outer thread formed on the terminal post and having an orifice formed in the terminal post for engaging with an electric cable, an actuating device including a housing having a chamber formed in the housing, and a casing attached to the housing and having a non-circular compartment formed in the casing, a torque limiting mechanism including a follower rotatably engaged in the chamber of the housing and having an inner thread formed in the follower for engaging with the outer thread of the terminal post, and having a number of ratchet teeth provided on the follower, and a release member slidably engaged in the chamber of the housing and having a number of ratchet teeth for engaging with the ratchet teeth of the follower, the release member including a non-circular stud for slidably engaging with the non-circular compartment of the casing and for limiting the release member to slide relative to the housing and the casing and for preventing the release member from rotating relative to the housing, and a spring biasing member engaged between the release member and the casing for biasing the ratchet teeth of the release member to engage with the ratchet teeth of the follower, the release member is forced to slide onto the spring biasing member and to move away from the follower with a sliding engagement between the ratchet teeth of the release member and the ratchet teeth of the follower when a torque applied to the housing and onto the terminal post is greater than a predetermined torque value of the spring biasing member, allowing the follower to be released.

The housing includes a peripheral flange provided therein, and the follower includes a protrusion for forming a peripheral shoulder and for engaging with the peripheral flange of the housing and for anchoring the follower to the housing and for limiting the follower to rotate relative to the housing only.

The follower includes a lock ring attached to the protrusion and engaged with the peripheral flange of the housing for rotatably anchoring the follower to the housing. The follower includes an engaging member provided on the protrusion, and the lock ring includes an engaging member for engaging with the engaging member of the follower and for rotatably anchoring the follower to the housing.

The actuating device includes a control ferrule attached to the housing and the casing and rotated in concert with the housing and the casing. The release member includes a peripheral recess formed therein for engaging with the spring biasing member and for anchoring the spring biasing member to the release member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
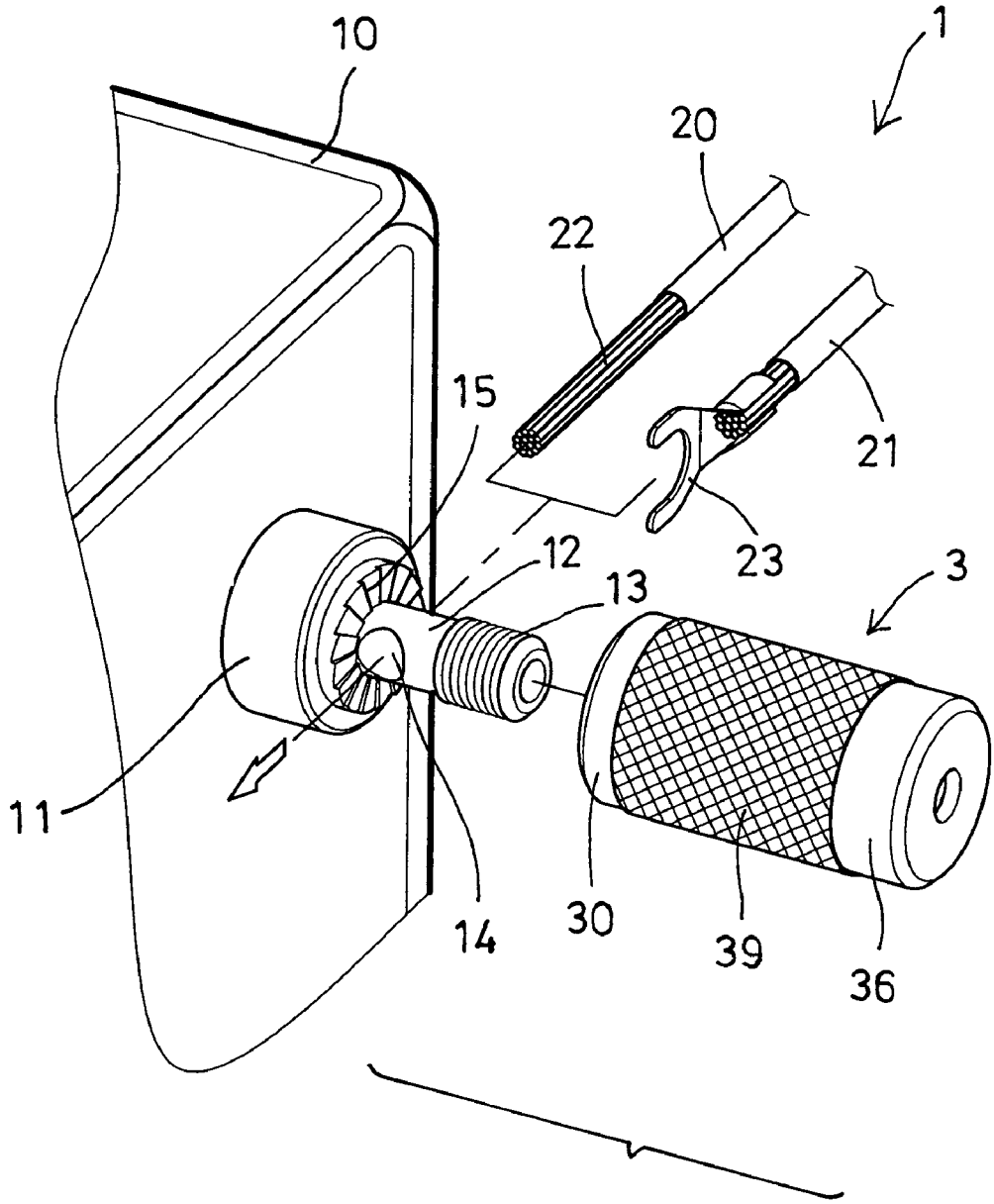
FIG. 1 is a partial exploded view illustrating an attachment of an electric cable connecting device or assembly in accordance with the present invention to a terminal post of an electric facility.
Figure 2:
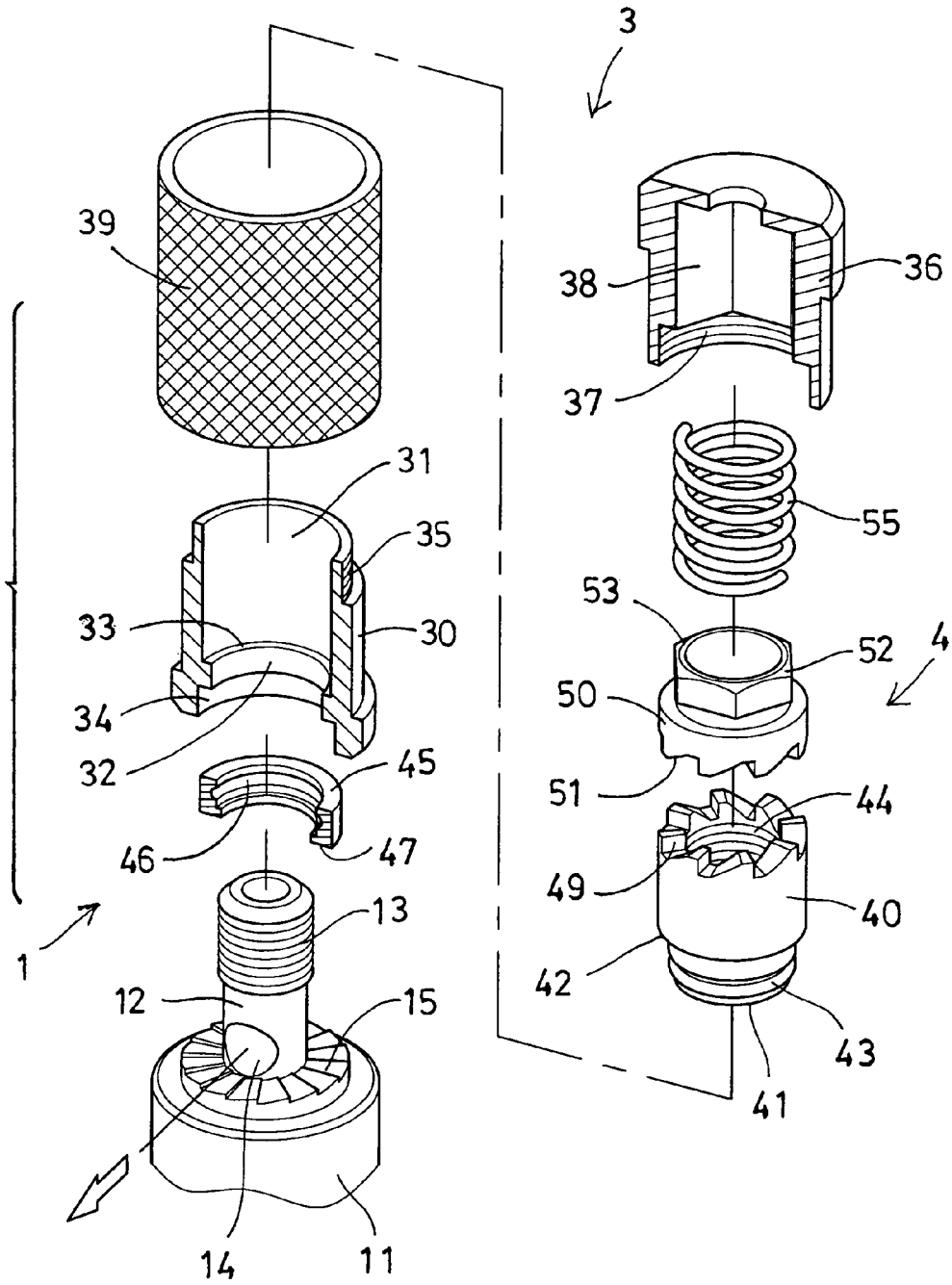
FIG. 2 is another partial exploded view of the electric cable connecting device.
Figure 3:
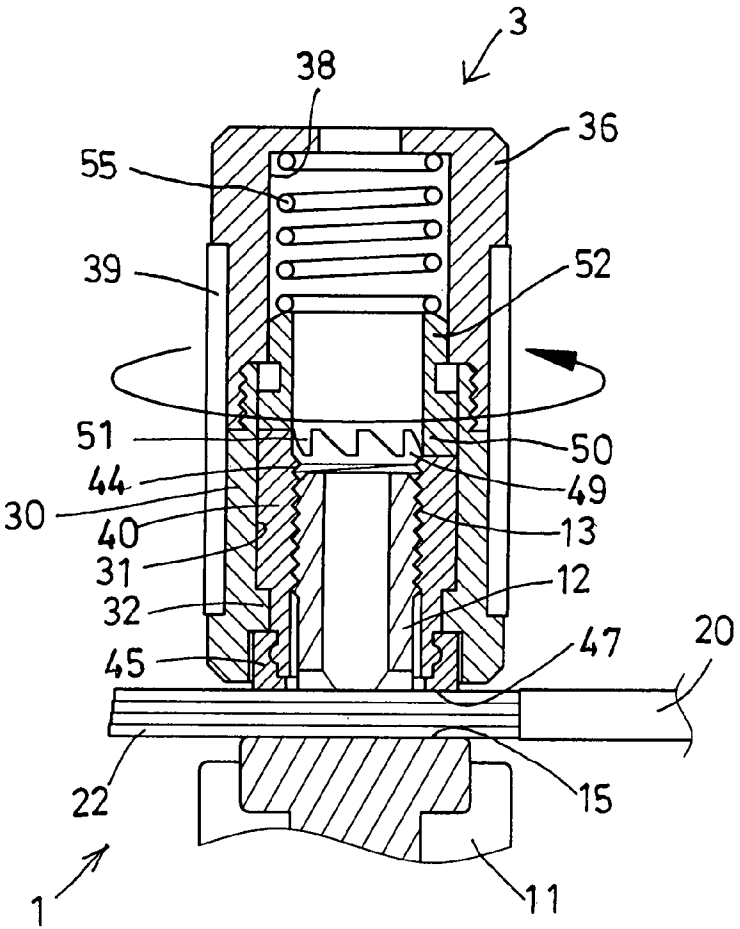
FIG. 3 is a partial cross sectional view illustrating the operation of the electric cable connecting device.

Referring to the drawings, and initially to FIGS. 1-3, an electric cable connecting device or assembly 1 in accordance with the present invention comprises an electric facility or a base member 10 including a protrusion or seat 11 extended upwardly or outwardly therefrom, and including an electric conductive terminal post 12 extended from the seat 11 or directly extended upwardly or outwardly from the electric facility or base member 10, and including an outer thread 13 formed or provided on the outer or free end portion of the terminal post 12, and including an orifice 14 formed in the terminal post 12 and located closer to the seat 11 or the base member 10, and including a rugged or serrated surface 15 formed on the seat 11 or the base member 10 and located or arranged around the terminal post 12.

The terminal post 12 is provided for electrically connecting or coupling to various kinds of electric cables 20, 21, for example, the electric cable 20 may include one or more conductive wires 22 for engaging into or through the orifice 14 of the terminal post 12 and to be secured or coupled to the terminal post 12, or the other electric cable 21 may include an electric conductive tab 23 for engaging onto the terminal post 12 and to be secured or coupled to the terminal post 12. The electric cable connecting device or assembly 1 further includes a rotating or driving or operating or actuating device 3 with a protective or torque limiting mechanism 4 for preventing the operating or actuating device 3 from being over rotated or over turned and for preventing the operating or actuating device 3 from being damaged brutally by the user.

The operating or actuating device 3 includes a container or housing 30 having a bore or chamber 31 formed therein, and includes a peripheral flange 32 formed or extended in the inner peripheral portion of the housing 30 for forming or defining a peripheral shoulder 33 in the upper portion of the peripheral flange 32, and for further forming or defining a peripheral space 34 in the lower portion of the peripheral flange 32, and includes an outer thread 35 formed or provided on the outer peripheral portion of the housing 30 for threading or engaging with the corresponding inner thread 37 of a cover or casing 36 and for solidly and stably attaching or mounting or securing the casing 36 to the housing 30, and includes a non-circular compartment 38 formed in the casing 36. A sleeve or control ferrule 39 may further be provided and attached or mounted or secured to the housing 30 and the casing 36 and rotated in concert with the housing 30 and the casing 36.

The protective or torque limiting mechanism 4 includes a follower 40 pivotally or rotatably received or engaged into the chamber 31 of the housing 30 and having a protrusion 41 extended downwardly or outwardly therefrom for forming or defining an outer peripheral shoulder 42 and for engaging with the corresponding peripheral shoulder 33 of the housing 30 and for anchoring or securing or retaining the follower 40 to the housing 30 and for limiting the follower 40 to rotate relative to the housing 30 only and for preventing the follower 40 from sliding longitudinally along or relative to the housing 30. The protrusion 41 of the follower 40 will be extended and engaged through the peripheral flange 32 of the housing 30 and will be extended and engaged into the peripheral space 34 of the housing 30.

Figure 4:
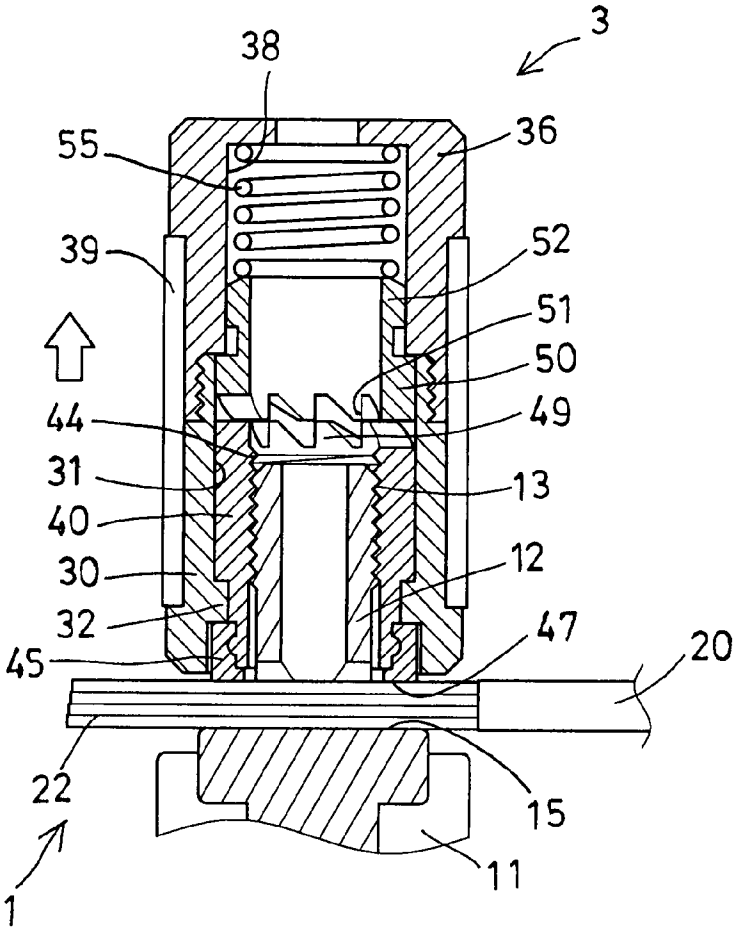
FIG. 4 is a partial cross sectional view similar to FIG. 3, illustrating the operation of the electric cable connecting device.

The follower 40 may further include a peripheral bulge or swelling or engaging member 43 for engaging with a peripheral groove or slot or engaging member 46 of a retaining or lock ring 45 which is engaged with the peripheral flange 32 of the housing 30, and for solidly and stably and rotatably attaching or mounting or anchoring or securing the follower 40 to the housing 30. As shown in FIGS. 3 and 4, the lock ring 45 may include a lower or bottom or outer engaging surface 47 for contacting or engaging with the electric conductive tab 23 or the conductive wires 22 which may be engaged with the serrated surface 15 of the base member 10. The follower 40 further includes an inner thread 44 formed therein for threading or engaging with the outer thread 13 of the terminal post 12 and for being rotated or driven or moved to engage with the electric conductive tab 23 or the conductive wires 22 when the follower 40 is rotated relative to the housing 30.

The follower 40 further includes a number of ratchet teeth 49 formed or provided on the upper portion thereof, and the protective or torque limiting mechanism 4 further includes an anchored or slide or release member 50 slidably received or engaged in the chamber 31 of the housing 30 and having a number of ratchet teeth 51 formed or provided on the lower or bottom portion thereof for engaging with the corresponding ratchet teeth 49 of the follower 40, and the slide or release member 50 includes a non-circular bulge or swelling or stud 52 extended upwardly therefrom for slidably receiving or engaging with the corresponding non-circular compartment 38 of the casing 36 and for guiding or limiting the release member 50 to slide longitudinally along or relative to the housing 30 and the casing 36 only and for preventing the release member 50 from rotating relative to the housing 30.

The slide or release member 50 further includes a peripheral seat or slot or recess 53 formed in the upper portion thereof for receiving or engaging with a spring biasing member 55 and for solidly and stably anchoring or securing or retaining the spring biasing member 55 to the release member 50, the spring biasing member 55 is disposed or engaged between the release member 50 and the casing 36 and is provided for biasing or forcing the ratchet teeth 51 of the release member 50 to engage with the corresponding ratchet teeth 49 of the follower 40 and to limit or to guide or to control the rotational movement between the release member 50 and the follower 40.

In operation, as shown in FIG. 3, after the electric conductive tab 23 is engaged onto the terminal post 12 or the conductive wires 22 are engaged into or through the orifice 14 of the terminal post 12, the housing 30 and the casing 36 may be rotated and engaged onto the terminal post 12 to have the inner thread 44 of the follower 40 to engage with the corresponding outer thread 13 of the terminal post 12 until the lower or bottom or outer engaging surface 47 of the lock ring 45 is contacted or engaged with the electric conductive tab 23 or the conductive wires 22, and the electric conductive tab 23 or the conductive wires 22 may be solidly and stably secured to the seat 11 or the terminal post 12 by further rotating the housing 30 and the casing 36 relative to the terminal post 12.

When the rotational force or the torque applied, by the user, to the housing 30 and the casing 36 and onto the terminal post 12 is greater than the predetermined level or torque value of that of the spring biasing member 55, the release member 50 may be forced to slide or move onto the spring biasing member 55 and to slide or move away from the follower 40 with the sliding engagement between the ratchet teeth 51 of the release member 50 and the ratchet teeth 49 of the follower 40, as shown in FIG. 4, such that the lock ring 45 will not be further forced and moved onto the electric conductive tab 23 or the conductive wires 22, and such that the threading engagement between the inner thread 44 of the follower 40 and the corresponding outer thread 13 of the terminal post 12 will not be damaged by over-rotating.

Figure 5:
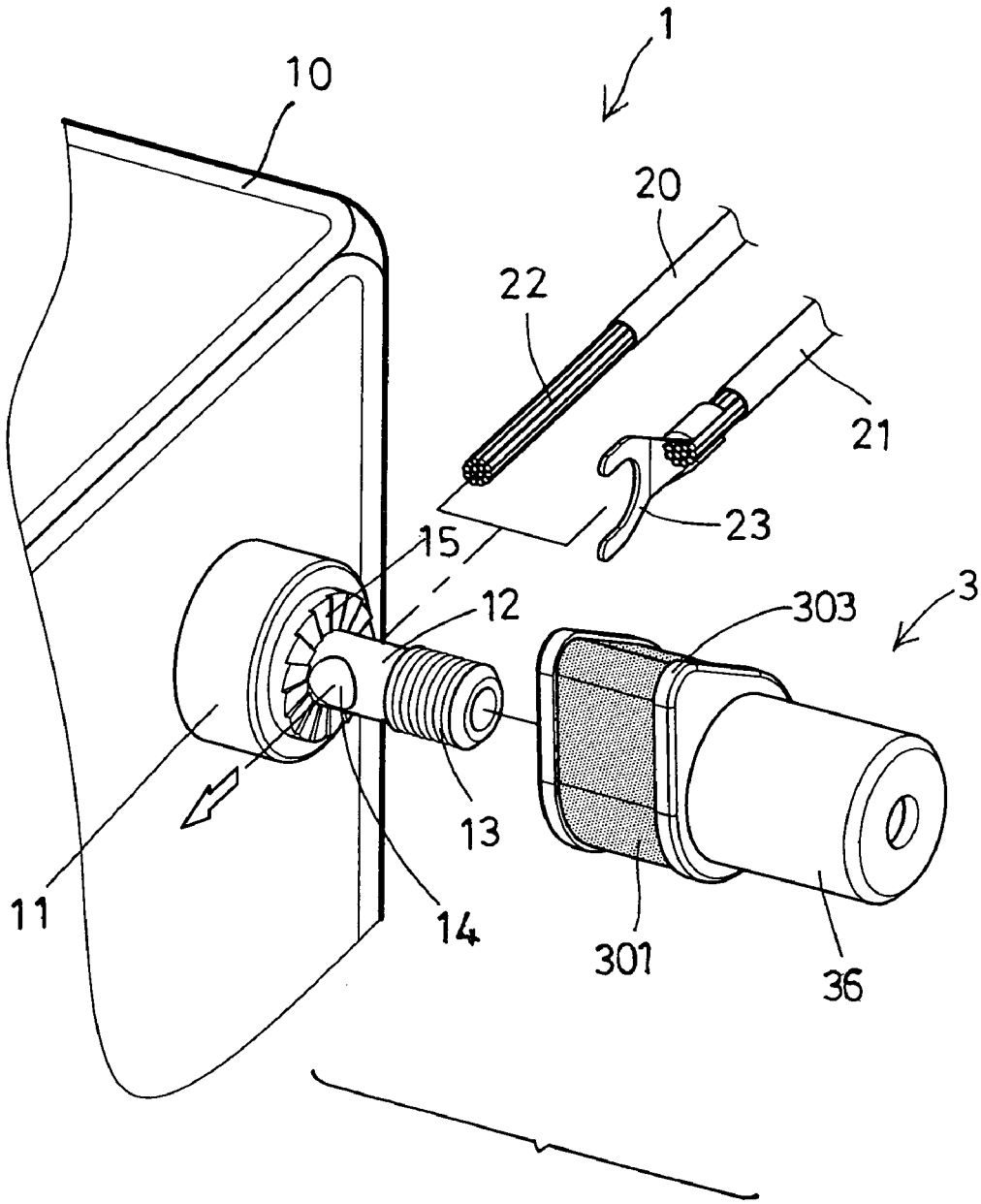
FIG. 5 is a further partial exploded view illustrating the operation of the other arrangement of the electric cable connecting device or assembly.
Figure 6:
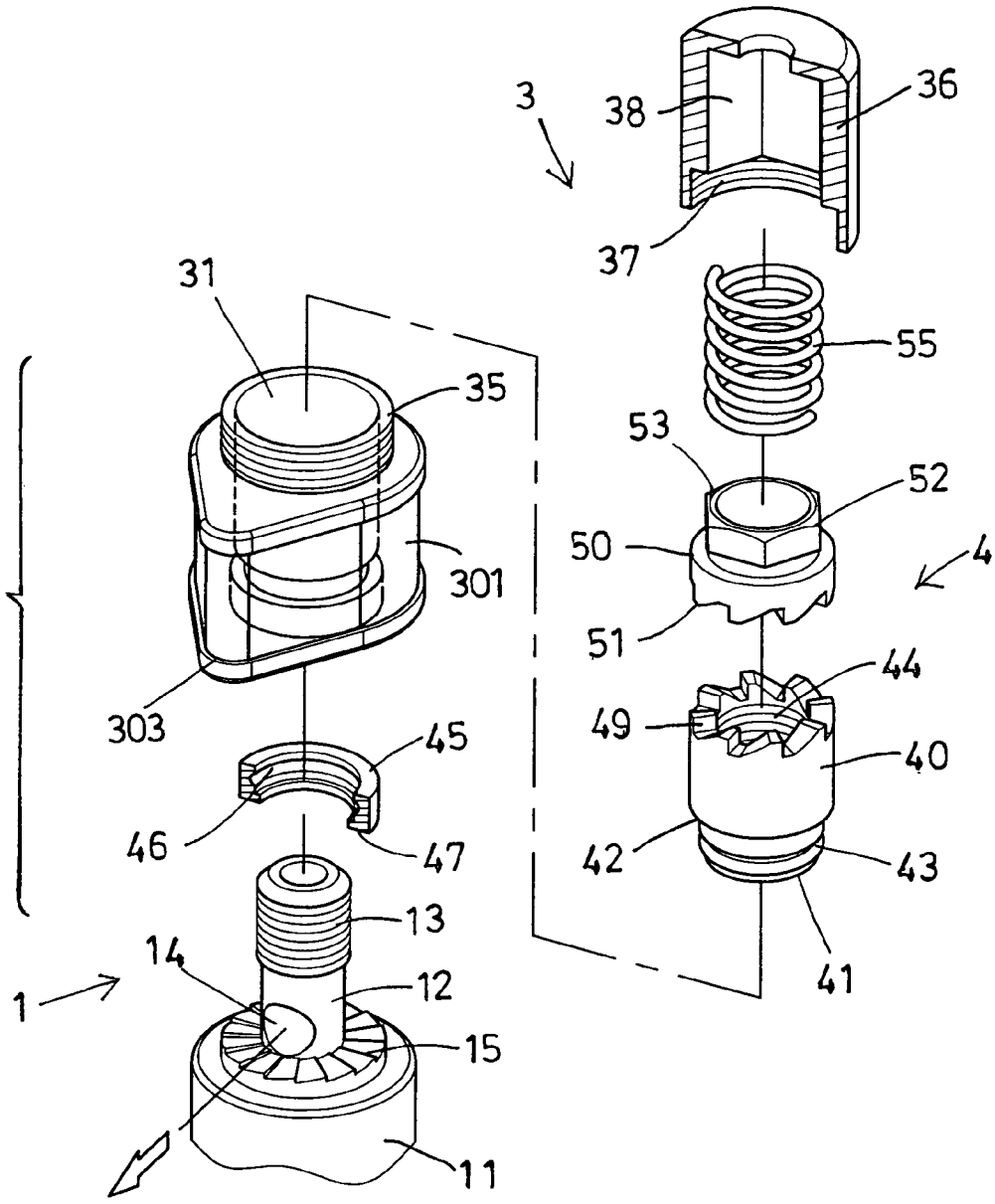
FIG. 6 is a still further partial exploded view illustrating the electric cable connecting device as shown in FIG. 5.
Figure 7:
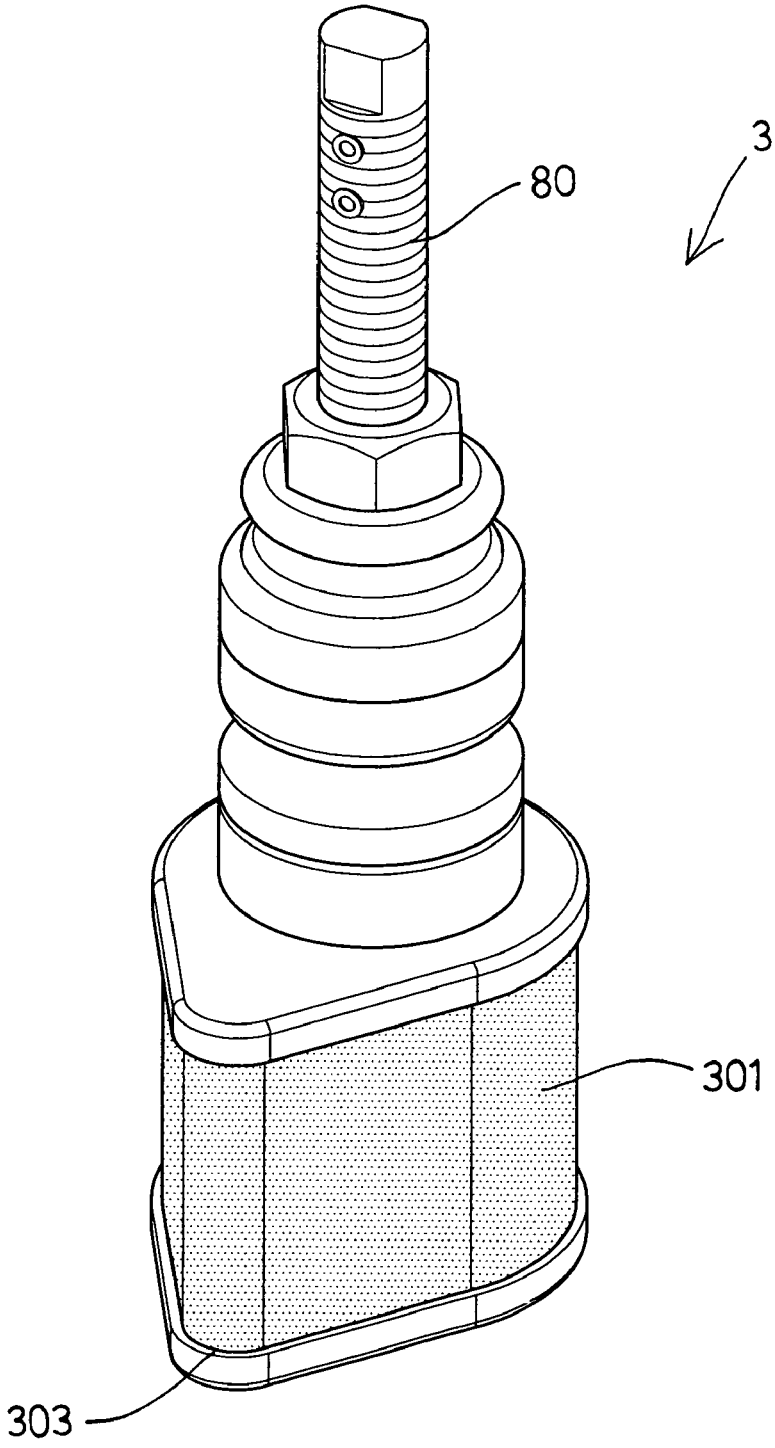
FIG. 7 is a perspective view of the electric cable connecting device as shown in FIGS. 5 and 6.

Alternatively, as shown in FIGS. 5-6, the housing 301 may be formed into the other shape or configuration having a protruded bulge or swelling or handgrip 303 formed or provided thereon for allowing the housing 301 to be easily rotated relative to the terminal post 12. As shown in FIG. 7, the housing 301 may be threaded or engaged with the longitudinal bolt 80 or the like.

Accordingly, the electric cable connecting device or assembly in accordance with the present invention includes a protective device or torque limiting device for preventing the connecting device from being over rotated or over turned and for preventing the connecting device from being damaged brutally by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric cable connecting device comprising:

a base member including a terminal post having an outer thread formed on said terminal post and having an orifice formed in said terminal post for engaging with an electric cable, an actuating device including a housing having a chamber formed in said housing, and a casing attached to said housing and having a non-circular compartment formed in said casing, a torque limiting mechanism including a follower rotatably engaged in said chamber of said housing and having an inner thread formed in said follower for engaging with said outer thread of said terminal post, and having a plurality of ratchet teeth provided on said follower, and a release member slidably engaged in said chamber of said housing and having a plurality of ratchet teeth for engaging with said ratchet teeth of said follower, said release member including a non-circular stud for slidably engaging with said non-circular compartment of said casing and for limiting said release member to slide relative to said housing and said casing and for preventing said release member from rotating relative to said housing, and a spring biasing member engaged between said release member and said casing for biasing said ratchet teeth of said release member to engage with said ratchet teeth of said follower, wherein said release member is forced to slide onto said spring biasing member and to move away from said follower with a sliding engagement between said ratchet teeth of said release member and said ratchet teeth of said follower when a torque applied to said housing and onto said terminal post is greater than a predetermined torque value of said spring biasing member, allowing said follower to be released.

2. The electric cable connecting device as claimed in claim 1, wherein said housing includes a peripheral flange provided therein, and said follower includes a protrusion for forming a peripheral shoulder and for engaging with said peripheral flange of said housing and for anchoring said follower to said housing and for limiting said follower to rotate relative to said housing only.

3. The electric cable connecting device as claimed in claim 2, wherein said follower includes a lock ring attached to said protrusion and engaged with said peripheral flange of said housing for rotatably anchoring said follower to said housing.

4. The electric cable connecting device as claimed in claim 3, wherein said follower includes an engaging member provided on said protrusion, and said lock ring includes an engaging member for engaging with said engaging member of said follower and for rotatably anchoring said follower to said housing.

5. The electric cable connecting device as claimed in claim 1, wherein said actuating device includes a control ferrule attached to said housing and said casing and rotated in concert with said housing and said casing.

6. The electric cable connecting device as claimed in claim 1, wherein said release member includes a peripheral recess formed therein for engaging with said spring biasing member and for anchoring said spring biasing member to said release member.

* * * * *